US009841177B2

(12) United States Patent
Liu et al.

(10) Patent No.: US 9,841,177 B2
(45) Date of Patent: Dec. 12, 2017

(54) COSMETIC MIRROR

(71) Applicants: BOE TECHNOLOGY GROUP CO., LTD., Beijing (CN); BOE Optical Science and Technology Co., Ltd., Suzhou, Jiangsu (CN)

(72) Inventors: Fei Liu, Beijing (CN); Xiao Li, Beijing (CN); Yaohui Li, Beijing (CN); Lin He, Beijing (CN)

(73) Assignees: BOE TECHNOLOGY GROUP CO., LTD., Beijing (CN); BOE OPTICAL SCIENCE AND TECHNOLOGY CO., LTD., Suzhou, Jiangsu (CN)

( * ) Notice: Subject to any disclaimer, the term of this patent is extended or adjusted under 35 U.S.C. 154(b) by 269 days.

(21) Appl. No.: 14/415,626

(22) PCT Filed: May 30, 2014

(86) PCT No.: PCT/CN2014/078969

§ 371 (c)(1),
(2) Date: Jan. 19, 2015

(87) PCT Pub. No.: WO2015/090011

PCT Pub. Date: Jun. 25, 2015

(65) Prior Publication Data

US 2016/0025325 A1 Jan. 28, 2016

(30) Foreign Application Priority Data

Dec. 17, 2013 (CN) ..... 2013 1 0693857

(51) Int. Cl.
*F21V 33/00* (2006.01)
*A45D 42/10* (2006.01)
(Continued)

(52) U.S. Cl.
CPC ..... *F21V 33/004* (2013.01); *A45D 42/04* (2013.01); *A45D 42/10* (2013.01); *F21L 4/08* (2013.01); *F21V 21/145* (2013.01); *F21V 23/003* (2013.01)

(58) Field of Classification Search
CPC .... F21V 33/004; F21V 21/145; F21V 23/003; A45D 42/10; A45D 42/04; F21L 4/08
See application file for complete search history.

(56) References Cited

U.S. PATENT DOCUMENTS 2,468,248 A * 4/1949 Wachtel ..... A45C 15/06 362/137
6,347,876 B1 2/2002 Burton
(Continued)

FOREIGN PATENT DOCUMENTS

CN 2798685 Y 7/2006
CN 101185168 A 5/2008
(Continued)

OTHER PUBLICATIONS

English translation of the Form PCT-ISA-237 in the international search report of PCT/CN2014/078969 dated Sep. 22, 2014.
(Continued)

*Primary Examiner* — Thomas M Sember
(74) *Attorney, Agent, or Firm* — Nath, Goldberg & Meyer; Joshua B. Goldberg

(57) ABSTRACT

Embodiments of the present invention provide a cosmetic mirror, relating to the technical field of electronic equipment. The cosmetic mirror comprises a mirror surface part and a lighting part, wherein the mirror surface of the mirror surface part and the light-emitting surface of the lighting part are positioned on the same side; and the lighting part is a surface light source formed by an organic light-emitting diode panel. By adopting the cosmetic mirror with such a structure, the thickness of the light source in the cosmetic mirror can be reduced, and the quality of the light source can be improved.

20 Claims, 4 Drawing Sheets

(51) Int. Cl.

| | |
|---|---|
| ***A45D 42/04*** | (2006.01) |
| ***F21L 4/08*** | (2006.01) |
| ***F21V 21/14*** | (2006.01) |
| ***F21V 23/00*** | (2015.01) |

(56) References Cited

U.S. PATENT DOCUMENTS

| | | | | |
|---|---|---|---|---|
| 7,780,322 | B2 * | 8/2010 | Muller | B60J 3/0282 313/504 |
| 2005/0264891 | A1 * | 12/2005 | Uken | B60R 1/12 359/606 |
| 2013/0188339 | A1 * | 7/2013 | Wang | F21V 33/004 362/135 |

FOREIGN PATENT DOCUMENTS

| | | | |
|---|---|---|---|
| CN | 101700150 | A | 5/2010 |
| CN | 101902937 | A | 12/2010 |
| CN | 201727033 | U | 2/2011 |
| CN | 202515153 | U | 11/2012 |
| CN | 103653689 | A | 3/2014 |
| CN | 203709490 | U | 7/2014 |
| DE | 102005003157 | A1 | 8/2006 |
| KR | 20100007622 | U | 7/2010 |

OTHER PUBLICATIONS

First Office Action of CN Application No. 201310693857.1 dated Jul. 13, 2015 and its English Translation.

International Patent Application No. PCT/CN2014/078969, International Search Report dated, Aug. 25, 2014, thirteen (13) pages.

* cited by examiner

COSMETIC MIRROR

This is a National Phase Application filed under 35 U.S.C. 371 as a national stage of PCT/CN2014/078969, filed May 30, 2014, an application claiming benefit from Chinese Patent Application No. 201310693857.1 filed on Dec. 17, 2013, the content of each of which is hereby incorporated by reference in its entirety.

FIELD OF THE INVENTION

The present invention relates to the technical field of electronic equipment, and in particular relates to a cosmetic mirror.

BACKGROUND OF THE INVENTION

In daily life, people always need to keep good makeup at all times, and particularly for ladies, a carry-on portable cosmetic mirror may bring convenience to makeup fix at any time and any place.

The function of an existing cosmetic mirror is relatively simple, and the biggest disadvantage thereof lies in that, when the ambient light is relatively weak, the imaging effect of the mirror surface is greatly degraded, and particularly at night or in a room with a weak light source, the cosmetic mirror can hardly be used, which greatly impairs the user experience. To solve such a problem, a cosmetic mirror with a light source has been proposed in the prior art, as shown in FIG. 1, a plurality of LED (Light Emitting Diode) point light sources 2 are arranged around a mirror surface 1, so that it is possible to solve, to a certain extent, the problem that the cosmetic mirror cannot be used due to weak ambient light. However, such cosmetic mirror has the following shortcomings: since the LED point light sources arranged on the cosmetic mirror are generally thick, the cosmetic mirror is over-large, and thus unfavorable for carry-on and unattractive; besides, the LED point light sources 2 have problems of dazzle light, poor color rendering property and the like, therefore it is unlikely to simulate the effect of natural light properly and the colors of mirror images cannot be well reflected. In addition, in the structure of the existing cosmetic mirror in which the point light sources 2 are arranged around the mirror surface 1, only a single light irradiation angle may be produced, and consequently, the existing cosmetic mirror cannot meet the actual demand of users for light of multiple angles and therefore brings inconvenience to the users.

SUMMARY OF THE INVENTION

Embodiments of the present invention provide a cosmetic mirror, which is capable of reducing the thickness of a light source in the cosmetic mirror and improving the quality of the light source. Moreover, the cosmetic mirror provided by the embodiments of the present invention also allows a user to adjust angle and intensity of lighting and even the position and area of the light-emitting surface according to needs, so as to bring convenience to use of the user.

To achieve the above objectives, the embodiments of the present invention adopt the following technical solutions.

In an aspect of the embodiments of the present invention, provided is a cosmetic mirror, including a mirror surface part and a lighting part, wherein a mirror surface of the mirror surface part and a light-emitting surface of the lighting part are positioned on the same side of the cosmetic mirror; and the lighting part is a surface light source formed by an OLED (Organic Light-Emitting Diode) panel.

Preferably, in the cosmetic mirror with the above-mentioned structure, an angle between the mirror surface of the mirror surface part and the light-emitting surface of the lighting part is adjustable.

According to the cosmetic mirror provided by the embodiments of the present invention, the lighting part is a surface light source formed by an OLED panel. Because the OLED surface light source has the characteristics of ultra-thinness, no dazzle light, high color rendering property and the like, the lighting pan adopting the OLED surface light source can effectively reduce the overall thickness of the cosmetic mirror and improve the quality of the light source. Moreover, the cosmetic mirror provided by the embodiments of the present invention further has such a structure that the angle between the mirror surface of the mirror surface part and the light-emitting surface of the lighting part is adjustable. By adopting the cosmetic mirror with the structure, when light needs to be supplemented, the relative angle between the lighting part and the mirror surface part may be changed according to the requirement of a user, and then the light irradiation angle is changed, so that great convenience is brought to use of the user.

BRIEF DESCRIPTION OF THE DRAWINGS

To illustrate the technical solutions in the embodiments of the present invention or in the prior art more clearly, a brief introduction to the accompanying drawings which are needed in the description of the embodiments or the prior art will be made as below. Apparently, the accompanying drawings in the description below are merely some of the embodiments of the present invention, based on which other drawings may be obtained by those of ordinary skill in the art without any creative effort.

REFERENCE SYMBOLS

1—mirror surface,
2—LED point light source;
21—mirror surface part,
211—handheld area,
22—lighting part,
23—connecting part,
24—solar cell,
25—protective cover,
26—switching unit;
31—transparent OLED device,

32—reflective material layer;
41—solar panel,
42—cell controller,
43—battery,
44—AC-DC converter;
50—dimming unit,
51—dimming circuit,
52—touch dimming module,
53—photosensitive dimming module.

DETAILED DESCRIPTION OF THE EMBODIMENTS

Hereinafter, the technical solutions in the embodiments of the present invention will be described clearly and thoroughly in combination with the accompanying drawings in the embodiments of the present invention. Apparently, the embodiments described are merely a part, but not all, of the embodiments of the present invention. All of other embodiments, obtained by those of ordinary skill in the art based on the embodiments described in the present invention without any creative effort, fall into the protection scope of the present invention.

Embodiment 1

Figure 1:
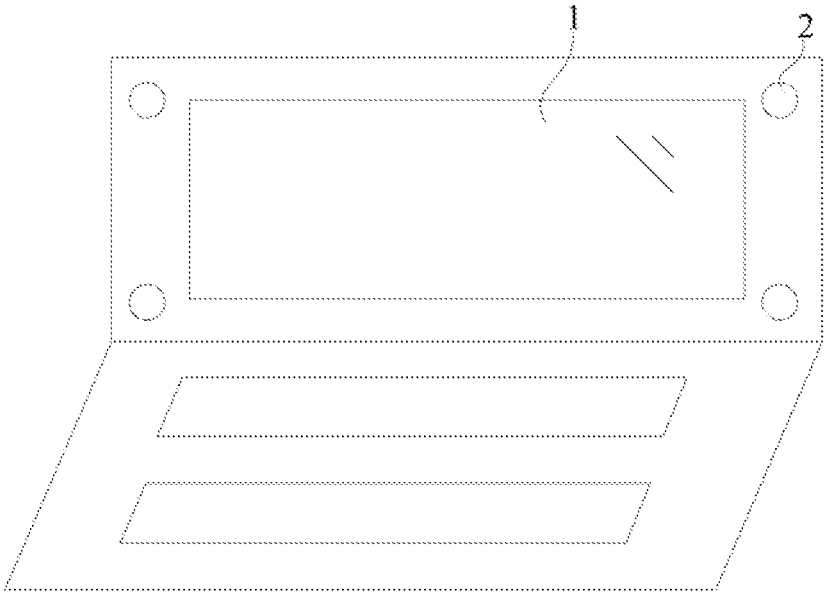
FIG. 1 is a schematic diagram of a structure of an existing cosmetic mirror.
Figure 2:
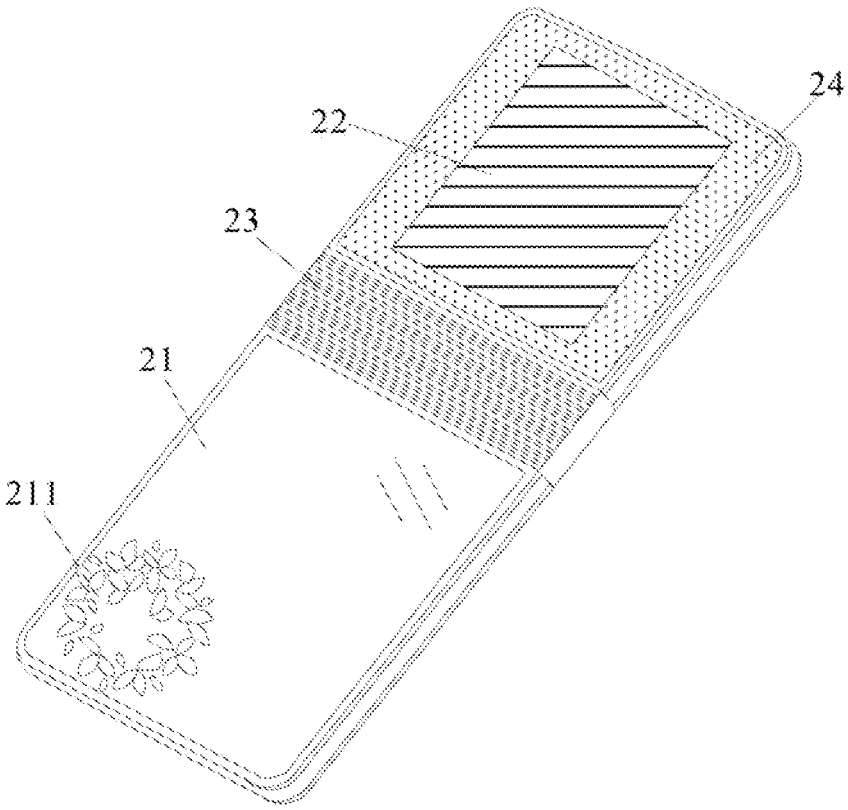
FIG. 2 is a schematic diagram of a structure of a cosmetic mirror provided by Embodiment 1 of the present invention.

A cosmetic mirror provided by the embodiment of the present invention, as shown in FIG. 2, includes a mirror surface part 21 at one end of the cosmetic mirror and a lighting part 22 at the other end of the cosmetic mirror. The mirror surface part 21 may adopt various reflectors with known structures.

The mirror surface of the mirror surface part 21 and the light-emitting surface of the lighting part 22 are positioned on the same side of the cosmetic mirror.

Wherein, the lighting part 22 is a surface light source formed by an OLED (Organic Light-Emitting Diode) panel.

Different from a traditional LED point light source, an OLED device mainly includes a very thin electroluminescent layer, which may emit light by applying an electric field thereto. Thus, a surface light source capable of stably emitting light, namely an OLED surface light source, may be formed by adopting a planar electroluminescent layer. Compared with the LED point light source, the OLED surface light source has the characteristics of thin thickness, no dazzle light, uniform light emitting, high color rendering property and the like. Thus, the cosmetic mirror with the above structure can truly reflect the status of an object in front of the mirror, improve the quality of the light source, and reduce the overall thickness of the cosmetic mirror.

Preferably, in the cosmetic mirror of this embodiment, a bendable connecting part 23 for movably connecting the mirror surface part 21 with the lighting part 22 is arranged between the mirror surface part 21 and the lighting part 22, so that the angle between the mirror surface of the mirror surface part 21 and the light-emitting surface of the lighting part 22 may be adjusted.

By adopting the cosmetic mirror with the preferred structure, when light needs to be supplemented, the relative angle between the lighting part 22 movably connected with the mirror surface part 21 and the mirror surface part 21 may be changed according to the requirement of a user, and then the light irradiation angle is changed, so that great convenience is brought to use of the user.

Embodiment 2

Figure 3:
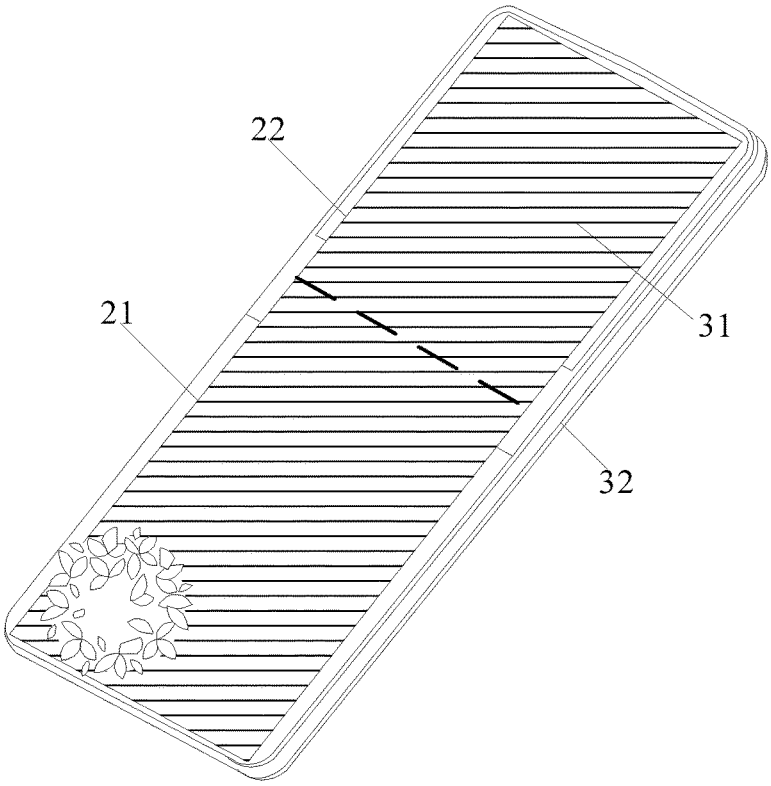
FIG. 3 is a schematic diagram of a structure of a cosmetic mirror provided by Embodiment 2 of the present invention.

Embodiment 2 of the present invention provides a cosmetic mirror. As shown in FIG. 3, the difference between the cosmetic mirror provided by this embodiment and the cosmetic mirror provided by Embodiment 1 shown in FIG. 2 lies in that the mirror surface part 21 and the lighting part 22 may be integrated as an OLED panel.

Specifically, the OLED panel may include a transparent OLED device 31 and a reflective material layer 32 formed on the surface of one side of the transparent OLED device 31.

Wherein, an electroluminescent element, a driving circuit and the like of the traditional OLED device are generally non-transparent, and these non-transparent elements may be highly integrated in a small area of each pixel unit of the OLED panel during design, so that the large area of the OLED panel may be light transmittable; by further arranging transparent electrodes on both sides of the electroluminescent element, the transparent OLED device 31 may emit light, such that the transparent OLED device 31 is formed as an OLED surface light source. In this way, the transmittance and luminance of the transparent OLED device 31 may be controlled by controlling the display gray-scale value of the transparent OLED device 31. Further, the reflective material layer 32 may specifically adopt mercury or other metal coating with good reflecting property, and when the transparent OLED device 31 is in a transparent state, the transparent OLED device 31 and the reflective material layer 32 are used cooperatively to form a structure similar to a mirror, so that the function of the mirror surface part 21 is realized; and when the transparent OLED device 31 emits light, the reflective material layer 32 may further reflect the light emitted by the transparent OLED device 31, so that all the light emitted by the transparent OLED device 31 exits from the surface of the transparent OLED device 31, so as to realize the function of the lighting part 22. Thus, the positions, shapes and sizes of the mirror surface part and the lighting part of the cosmetic mirror may be changed freely by users according to actual needs.

Further, different from the structure shown in FIG. 2 that the mirror surface part 21 is movably connected with the lighting part 22 by adopting the bendable connecting part 23 between the mirror surface part 21 and the lighting part 22, the mirror surface part 21 and the lighting part 22 in this embodiment may be formed as an integrated structure as shown in FIG. 3, and the OLED panel may be made of a flexible material. Thus, the angle between the mirror surface of the mirror surface part and the light-emitting surface of the lighting part may be changed by bending the cosmetic mirror with the flexible structure to select an optimal lighting angle, so that the user experience of using the cosmetic mirror is greatly improved.

The cosmetic mirror as shown in FIG. 3 may further include:

a control unit (not shown in FIG. 3), which may be used for controlling the display gray scale of the OLED device 31 in different areas of the OLED panel, so that the transparent OLED device 31 in a certain area is in a transparent state, the mirror surface part 21 is formed in this area, the transparent OLED device 31 in the other area emits light, and the lighting part 22 is formed in the other area.

It should be noted that, the areas and positions of the mirror surface part 21 and the lighting part 22 in the cosmetic mirror may be changed according to actual needs of users. For example, multiple lighting modes may be preset in the control unit, e.g. the area ratio of the mirror surface part 21 to the lighting part 22 is 1:1, 2:1 or 3:1 and the like, and a user may select one of the multiple modes according to the actual need. For another example, a touch screen may be arranged on the surface of the cosmetic mirror, and a user may select and mark out the positions and areas of the mirror surface part 21 and the lighting part 22 by finger. Of course, marking out of areas and selection of positions of the mirror surface part 21 and the lighting part 22 may be realized in other selection manners, and the present invention is not limited thereto. After the lighting mode is set, the control unit may control the corresponding area to realize the transparent state or light emitting of the transparent OLED device 31.

Particularly, when the lighting part is not marked out in the cosmetic mirror, the cosmetic mirror may be only used as a mirror, e.g. when a user uses the cosmetic mirror outdoors (full of light), in order that the range reflected by the mirror is maximized, the lighting part does not need to be marked out. Or, when the mirror surface part is not marked out in the cosmetic mirror, the cosmetic mirror may be only used as a lighting device, e.g. when a user is in a dark environment and does not need to use the mirror, the mirror surface part does not need to be marked out, so that whole of the cosmetic mirror may be used as a lighting device for lighting.

By adopting the cosmetic mirror with such a structure, because the light source formed by the OLED panel has the characteristics of ultra-thinness, no dazzle light, high color rendering property and the like, the lighting part adopting the OLED surface light source may reduce the overall thickness of the cosmetic mirror and improve the quality of the light source. Further, the cosmetic mirror of this embodiment adopts a transparent flexible OLED panel with an integrated structure, so that a user may change the shapes and sizes of the mirror surface part and the lighting part of the cosmetic mirror freely according to actual needs and change the angle between the mirror surface part and the lighting part by bending the cosmetic mirror to select an optimal lighting angle, and therefore the user experience of using the cosmetic mirror is greatly improved.

Further preferably, in each embodiment of the present invention, the cosmetic mirror may further include:

a solar cell 24, which is mainly used for being charged under the irradiation of a light source and supplying power to the lighting part 22 when the lighting part 22 is needed for lighting.

It should be noted that, the solar cell 24 may be arranged on the front surface or back surface of the cosmetic mirror; in the cosmetic mirror as shown in FIG. 2, it is used as an example for illustration that the solar cell 24 is arranged around the lighting part 22; and when the cosmetic mirror is in an environment with a light source, the solar cell 24 is in a charging status.

Figure 4:
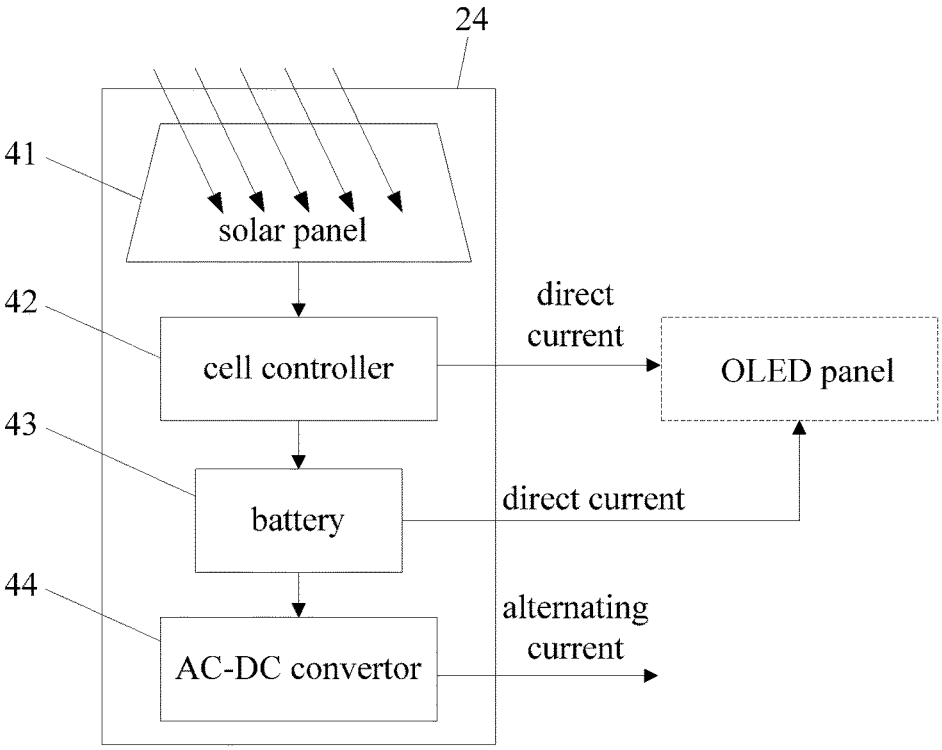
FIG. 4 is a schematic diagram of a circuit structure of a solar cell in a cosmetic mirror provided by a preferred embodiment of the present invention.

Specifically, as shown in FIG. 4, the solar cell 24 may structurally include a solar panel 41, a cell controller 42, a battery 43 and an AC-DC converter 44. Wherein, the solar panel 41 can convert solar energy into electric energy, the electric energy obtained by the solar panel 41 through conversion is input to the cell controller 42, one output end of the cell controller 42 is used for outputting DC driving current to the OLED panel, and the other output end of the cell controller 42 is used for inputting charging current to the battery 43; when the cosmetic mirror is in an environment without a light source or with a weak light source, the battery 43 may output DC current to the OLED panel; and when AC output is needed, the solar cell 24 may output the AC current through the AC-DC converter 44 connected with the battery 43. It should be noted that, the AC-DC converter 44 may be an optional device for the solar cell 24.

By adopting the cosmetic mirror with the solar cell, power supply for lighting of the lighting part may be realized through the solar energy, so that the battery does not need to be replaced, thereby achieving effects of energy saving and environmental protection.

Further preferably, in each embodiment of the present invention, the cosmetic mirror may further include:

a dimming unit 50, which is mainly used for adjusting the brightness of light emitted by the lighting part 22.

Figure 5:
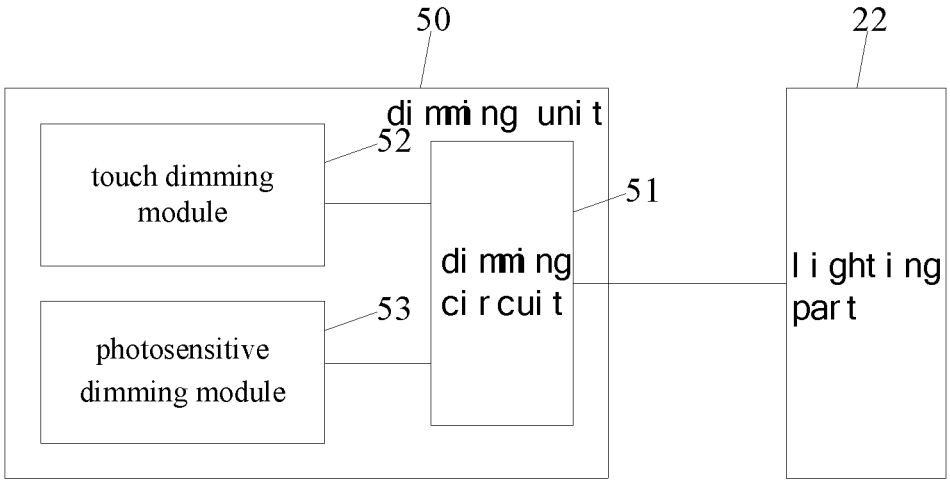
FIG. 5 is a schematic diagram of a circuit structure of a dimming unit in a cosmetic mirror provided by a preferred embodiment of the present invention.

Specifically, as shown in FIG. 5, the dimming unit 50 may specifically include a dimming circuit 51 and at least one of a touch dimming module 52 and a photosensitive dimming module 53.

Figure 6:
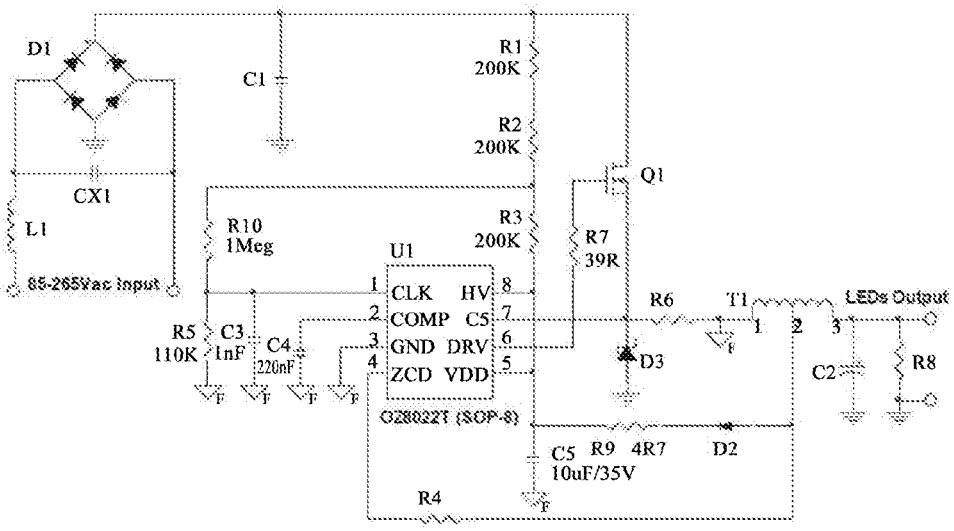
FIG. 6 is a schematic diagram of circuit connection of a dimming circuit in the dimming unit shown in FIG. 5.

In the embodiments of the present invention, the dimming circuit 51 may adopt various known dimming circuits in the prior art. For example, the structure of the dimming circuit 51 may be as shown in FIG. 6, and multi-level output of current is realized through an OZ8022T chip. Of course, it is only an example for illustration, and the present invention is not limited thereto.

Wherein, the touch dimming module 52 is mainly used for controlling the dimming circuit 51 according to a touch signal input by a user to adjust the brightness of light emitted by the lighting pan 22.

For example, a touch screen may be arranged on the surface of the lighting part 22 of the cosmic mirror; when a user needs to adjust the lighting brightness, the level thereof may be adjusted according to the brightness level displayed on the touch screen; or it is possible to set that the lighting brightness is gradually increased when a finger of the user slides along a first direction, while the lighting brightness is gradually reduced when the finger of the user slides along a second direction, such that the user may adjust an appropriate lighting brightness according to actual needs.

The photosensitive dimming module 53 is mainly used for controlling the dimming circuit 51 according to the brightness of ambient light to adjust the brightness of light emitted by the lighting part 22.

For example, the photosensitive dimming module 53 may be a photosensitive sensor arranged on the surface of the cosmetic mirror. When the lighting part 22 is turned on, the photosensitive dimming module 53 may automatically control the dimming circuit 51 according to the intensity of ambient light, so that the brightness of the light emitted by the lighting part 22 is correspondingly changed as changing of the intensity of the ambient light, and an optimal light supplementing effect is achieved.

Figure 7:
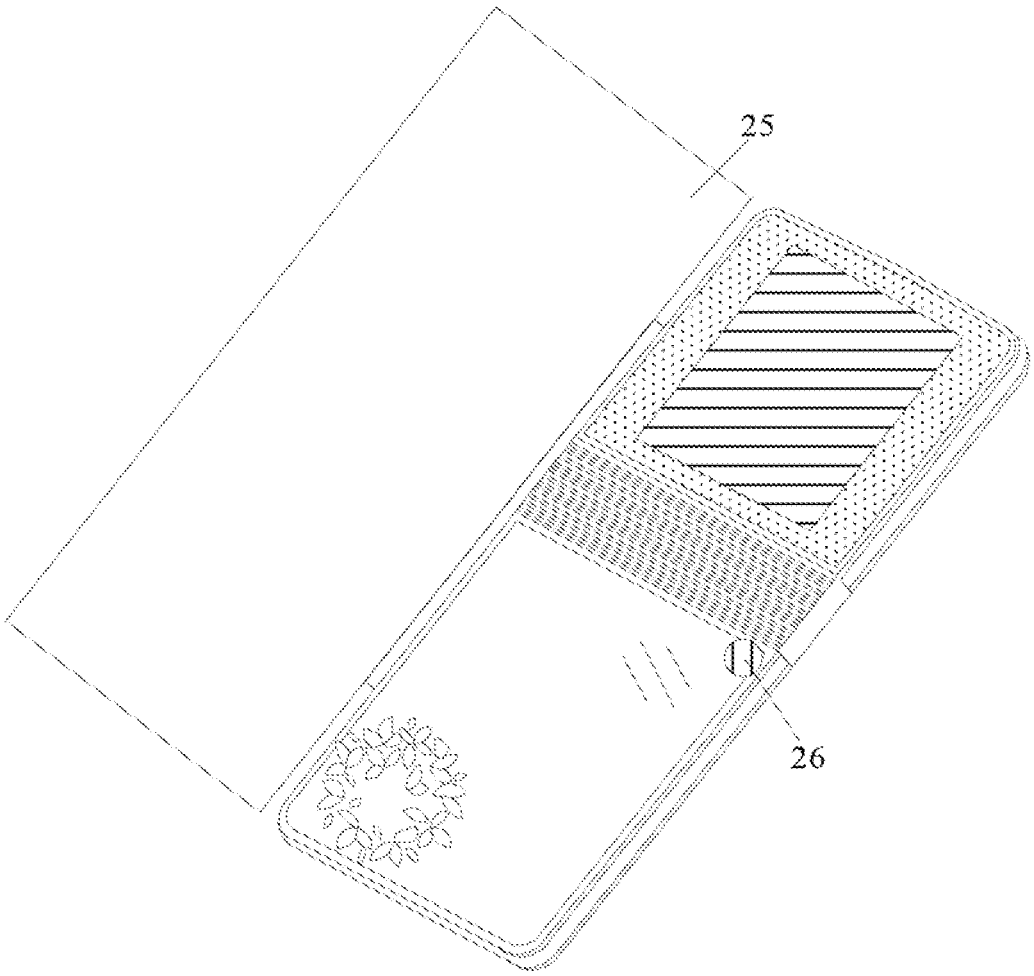
FIG. 7 is a schematic diagram of a preferred structure of a cosmetic mirror provided by a preferred embodiment of the present invention.

Further preferably, as shown in FIG. 7, in each embodiment of the present invention, the cosmetic mirror may further include:

a protective cover 25, which covers the mirror surface of the mirror surface part 21 and the light-emitting surface of the lighting part 22 in an openable and closeable manner.

Specifically, the protective cover 25 may be made of a soft material, such as leather. By adopting the protective cover 25, the surfaces of the mirror surface part 21 and the lighting part 22 may be prevented from being scratched or crashed due to careless use or storage, so that the service life of the product is effectively prolonged.

The cosmetic mirror as shown in FIG. 7 may further include:

a switching unit 26, which is used for controlling the lighting part 22 to perform lighting when the protective cover 25 is opened to a preset angle.

Specifically, the switching unit 26 may adopt any existing sensor with an opening angle measuring function. In the cosmetic mirror as shown in FIG. 7, it is used as an example for illustration that the switching unit 26 is arranged on the surface of the cosmetic mirror. Wherein, the preset angle may be an angle threshold preset according to the actual need, e.g. 20°, and when the included angle between the protective cover 25 and the cosmetic mirror is greater than the angle, the switching unit 26 turns on the lighting part 22 to supplement light.

Further preferably, as shown in FIG. 2, in the cosmetic mirror of each embodiment of the present invention, the mirror surface part 21 may further be provided with a handheld area 211.

Wherein, patterns may be formed on the surface of the handheld area 211 of the mirror surface part 21.

Through the patterns, the mirror surface may be prevented from being contaminated by fingerprints or stains due to handholding of a user, the imaging performance of the mirror surface may be ensured, the appearance attractiveness of the cosmetic mirror may be further improved, and the user experience is significantly improved.

The foregoing descriptions are merely specific embodiments of the present invention, rather than limiting the protection scope of the present invention. Any skilled one who is familiar with this art could readily think of variations or substitutions within the disclosed technical scope of the present invention, and these variations or substitutions shall fall within the protection scope of the present invention. Accordingly, the protection scope of the claims should prevail over the protection scope of the present invention.

The invention claimed is:

1. A cosmetic mirror, comprising a mirror surface part and a lighting part, wherein a mirror surface of the mirror surface part and a light-emitting surface of the lighting part are positioned on the same side of the cosmetic mirror, an area of the mirror surface part and an area of the lighting part are adjustable; and the lighting part is a surface light source formed by an organic light-emitting diode panel.

2. The cosmetic mirror of claim 1, wherein an angle between the mirror surface of the mirror surface part and the light-emitting surface of the lighting part is adjustable.

3. The cosmetic mirror of claim 2, wherein a bendable connecting part for connecting the mirror surface part with the lighting part is arranged between the mirror surface part and the lighting part, so that the angle between the mirror surface and the light-emitting surface is adjustable.

4. The cosmetic mirror of claim 2, further comprising:

a dimming unit, which is used for adjusting the brightness of light emitted by the lighting part.

5. The cosmetic mirror of claim 2, further comprising:

a protective cover, which covers the mirror surface of the mirror surface part and the light-emitting surface of the lighting part in an openable and closeable manner.

6. The cosmetic mirror of claim 2, wherein the mirror surface part is provided with a handheld area; and patterns are formed on a surface of the handheld area of the mirror surface part.

7. The cosmetic mirror of claim 1, wherein the mirror surface part and the lighting part are integrated as an organic light-emitting diode panel;

the organic light-emitting diode panel comprises a transparent organic light-emitting diode device and a reflective material layer formed on a surface of the transparent organic light-emitting diode device at one side thereof.

8. The cosmetic mirror of claim 7, wherein the organic light-emitting diode panel is made of a flexible material.

9. The cosmetic mirror of claim 7, further comprising:

a control unit, which is used for controlling the organic light-emitting diode panel, so that the transparent organic light-emitting diode device in one area of the organic light-emitting diode panel is in a transparent state to form the mirror surface part, and the transparent organic light-emitting diode device in the other area of the organic light-emitting diode panel emits light to form the lighting part.

10. The cosmetic mirror of claim 9, further comprising:

a dimming unit, which is used for adjusting the brightness of light emitted by the lighting part.

11. The cosmetic mirror of claim 9, further comprising:

a protective cover, which covers the mirror surface of the mirror surface part and the light-emitting surface of the lighting part in an openable and closeable manner.

12. The cosmetic mirror of claim 7, further comprising:

a dimming unit, which is used for adjusting the brightness of light emitted by the lighting part.

13. The cosmetic mirror of claim 7, further comprising:

a protective cover, which covers the mirror surface of the mirror surface part and the light-emitting surface of the lighting part in an openable and closeable manner.

14. The cosmetic mirror of claim 7, wherein the mirror surface part is provided with a handheld area; and patterns are formed on a surface of the handheld area of the mirror surface part.

15. The cosmetic mirror of claim 1, further comprising:

a solar cell, which is charged under the irradiation of a light source and is used for supplying power to the lighting part when the lighting part is needed for lighting.

16. The cosmetic mirror of claim 1, further comprising:

a dimming unit, which is used for adjusting the brightness of light emitted by the lighting part.

17. The cosmetic mirror of claim 16, wherein the dimming unit comprises a dimming circuit, a touch dimming module and/or a photosensitive dimming module;

the touch dimming module is used for controlling the dimming circuit according to a touch signal input by a user to adjust the brightness of light emitted by the lighting part; and the photosensitive dimming module is used for controlling the dimming circuit according to the brightness of ambient light to adjust the brightness of light emitted by the lighting part.

18. The cosmetic mirror of claim 1, further comprising:

a protective cover, which covers the mirror surface of the mirror surface part and the light-emitting surface of the lighting part in an openable and closeable manner.

19. The cosmetic mirror of claim 18, further comprising:

a switching unit, which is used for controlling the lighting part to perform lighting when the protective cover is opened to at least a preset angle.

20. The cosmetic mirror of claim 1, wherein the mirror surface part is provided with a handheld area; and patterns are formed on a surface of the handheld area of the mirror surface part.

* * * * *